US010153581B2

(12) United States Patent
Mitchell

(10) Patent No.: US 10,153,581 B2
(45) Date of Patent: Dec. 11, 2018

(54) SYSTEM AND METHOD FOR CONNECTING TO MARINE SHORE POWER

(71) Applicant: Vincent Mitchell, Helena, MT (US)

(72) Inventor: Vincent Mitchell, Helena, MT (US)

( * ) Notice: Subject to any disclaimer, the term of this patent is extended or adjusted under 35 U.S.C. 154(b) by 0 days.

(21) Appl. No.: 15/448,593

(22) Filed: Mar. 3, 2017

(65) Prior Publication Data

US 2017/0256899 A1 Sep. 7, 2017

Related U.S. Application Data

(60) Provisional application No. 62/302,404, filed on Mar. 2, 2016.

(51) Int. Cl.

| | |
|---|---|
| ***H01R 25/00*** | (2006.01) |
| ***H01R 13/53*** | (2006.01) |
| ***H01R 24/86*** | (2011.01) |
| ***H01R 31/06*** | (2006.01) |
| *B63J 3/04* | (2006.01) |

(52) U.S. Cl.

CPC ..... *H01R 13/53* (2013.01); *H01R 24/86* (2013.01); *H01R 31/06* (2013.01); *B63J 2003/043* (2013.01); *H01R 2201/26* (2013.01)

(58) Field of Classification Search

CPC ..... H01R 24/66; H01R 27/00; H01R 31/06; H01R 29/00

USPC ..... 439/638, 171, 518

See application file for complete search history.

(56) References Cited

U.S. PATENT DOCUMENTS

| | | | | |
|---|---|---|---|---|
| 3,079,475 | A | 2/1963 | Rumble | |
| 3,885,849 | A * | 5/1975 | Bailey | H01R 13/506 439/320 |
| 3,996,546 | A | 12/1976 | Hugly | |
| 4,053,788 | A | 10/1977 | Robie | |
| 5,514,009 | A | 5/1996 | Hughes | |
| 5,613,863 | A * | 3/1997 | Klaus | H01R 27/00 439/131 |
| 5,616,051 | A | 4/1997 | Rogers | |
| 5,626,495 | A | 5/1997 | Drewnicki | |
| 5,836,777 | A | 11/1998 | Chen | |
| 5,885,109 | A | 3/1999 | Lee | |

(Continued)

OTHER PUBLICATIONS

Hubbell Incorporated, Hubbell Marine Products, 2008, 56 pages, H5263, Hubbell Incorporated, 185 Plains Rd, Milford, CT 06461-2420, USA.

*Primary Examiner* — Hae Moon Hyeon

(74) *Attorney, Agent, or Firm* — Adam H. Owens, Esq.

(57) ABSTRACT

A system for providing marine shore power to a vessel regardless of the configuration of the shore power source or the configuration of any socket installed on the shore power source is disclosed. A vessel plug, which is intended to be installed on a vessel's shore power cable, has a male adapter component which accepts a plurality of adapters. The plurality of adapter each have a female socket component and a male adapter component. The male plug component of the vessel plug is compatible with and plugs into the female socket component of each of the plurality of adapters. Each of the male adapter components of the plurality of components are each configured differently so as to enable a vessel to connect to a shore power source regardless of the configuration of the shore power source or the configuration of any socket installed on the shore power source.

16 Claims, 8 Drawing Sheets

(56) References Cited

U.S. PATENT DOCUMENTS

| | | | | |
|---|---|---|---|---|
| 6,010,347 | A | 1/2000 | Lee | |
| 6,109,977 | A | 8/2000 | Baxter | |
| 6,220,880 | B1 * | 4/2001 | Lee | H01R 25/003 439/214 |
| 6,227,883 | B1 | 5/2001 | Lee | |
| 6,227,892 | B1 | 5/2001 | Kera | |
| 6,328,581 | B1 * | 12/2001 | Lee | H01R 31/06 439/106 |
| 6,517,380 | B1 | 2/2003 | Deutsch | |
| 6,638,113 | B2 | 8/2003 | Kajiwara et al. | |
| 6,845,023 | B2 | 1/2005 | Philips et al. | |
| 6,894,457 | B2 * | 5/2005 | Germagian | H02J 7/0042 320/119 |
| 6,929,515 | B1 * | 8/2005 | Schneider | H01R 27/00 439/654 |
| 6,991,483 | B1 * | 1/2006 | Milan | H01R 27/00 439/171 |
| 7,168,968 | B1 | 6/2007 | Li | |
| 7,232,322 | B1 | 6/2007 | Yen et al. | |
| 7,422,452 | B2 | 9/2008 | Achtner | |
| 7,465,901 | B2 * | 12/2008 | Yunk | B23K 9/32 219/130.1 |
| 7,614,892 | B2 | 11/2009 | Klant | |
| 7,817,055 | B1 | 10/2010 | Scanlon | |
| 7,993,164 | B2 * | 8/2011 | Chatterjee | H01R 39/64 439/172 |
| 8,033,847 | B1 | 10/2011 | Chen | |
| 8,033,867 | B1 | 10/2011 | Kessler | |
| 8,197,260 | B2 | 6/2012 | Wadsworth | |
| 8,313,350 | B2 | 11/2012 | Lee | |
| 8,708,722 | B1 | 4/2014 | Walliser | |
| 8,821,199 | B2 | 9/2014 | Sandoval et al. | |
| 8,884,773 | B2 | 11/2014 | Wiesemann et al. | |
| 8,939,781 | B2 * | 1/2015 | Johnson | H01R 27/00 310/71 |
| 9,083,125 | B2 * | 7/2015 | Rogers | H01R 27/00 |
| 9,136,658 | B2 * | 9/2015 | Chang | H01R 27/00 |
| 2007/0032109 | A1 | 2/2007 | Hung | |
| 2009/0081895 | A1 * | 3/2009 | Lee | H01R 24/68 439/173 |
| 2012/0045175 | A1 | 2/2012 | Ordo et al. | |

* cited by examiner

SYSTEM AND METHOD FOR CONNECTING TO MARINE SHORE POWER

CLAIM OF PRIORITY

This application claims the benefit of U.S. Provisional Application No. 62/302,404, filed Mar. 2, 2016, the entire disclosures of which are incorporate herein by reference.

STATEMENT CONCERNING FEDERALLY SPONSORED RESEARCH OR DEVELOPMENT

Not applicable.

BACKGROUND OF THE INVENTION

Field of the Invention

The present invention pertains generally to a marine shore power multi-adapter that utilizes three-phase electrical power service. More particularly, the invention relates to a marine shore power plug adapter system and method that enables the power system of a boat, yacht or marine vessel to connect to any variety of three-phase marine shore power electrical sources available to marine vessels at marina docking and berthing slips throughout the world.

Description of the Prior Art

Adapters for different types of electrical power supplies have been known in the prior art since the dawn of the modern power grid and improvements to the art are frequently provided. A relatively old example is provided by R. W. Rumble, entitled "Electrical Plug," U.S. Pat. No. 3,079,475, which was awarded patent protection in 1960. According to Rumble, his invention relates to electrical fittings which can be adjusted by the user to fit any one of a multiplicity of electrical sockets, which may be made to receive plugs having either two or three pins.

Yet another relatively old example is provided by Jean-Daniel Hugly, entitled "Plug For Voltage Adaptation," U.S. Pat. No. 3,996,546, which was awarded patent protection in 1976. According to Hugly, his invention relates to an electrical plug, more particularly a dual-voltage electrical plug which is adaptable to connect an appliance such as an electric shaver alternatively to sockets belonging to either one of two main supplies of differing voltage.

A relatively newer example is provided by Schneider et al., entitled "In-Line AC Adapter for Camping and Marine Electrical Service," U.S. Pat. No. 6,929,515, which was awarded patent protection on Aug. 16, 2005. According to Schneider et al., their invention relates to interfacing differing electrical systems, more particularly, to an adapter for connecting electrical lines of dissimilar terminal configurations.

Yet one more example is provided by Walliser and Mazieres, entitled "Power Adapter With Interchangeable Heads," U.S. Pat. No. 8,708,722, which was awarded patent protection on Apr. 29, 2014. According to Walliser and Mazieres, their invention relates to a power adapter with a cable port disposed on one side and a power conversion circuit to convert an input power from an alternating current (AC) power system to an output power used by a device coupled to the cable port. In addition, the power adapter allows for interchangeable heads, each with prongs suitable for different types of international AC power systems to allow the user to power electronic devices throughout the world with the use of only one power adapter.

Also known in the art are a variety of other related inventions purporting to allow electrical and electronic devices to be powered from a variety of differing types of electrical systems using adapters and/or power converters. Specific examples are too numerous to fully summarize herein.

In light of the above, there is an absence of prior art that pertain to plug adapter systems for providing high amperage three-phase electricity to a marine vessel, regardless of the type of plug configuration used on the shore power supply source. As is known in the art, many marinas throughout the world provide a shore power source at each or most of their docking and berthing slips. Each shore power source is connected to the local electrical supply grid. Typically, the shore power source at each docking and berthing slip is comprised of one or more electrical outlet or cables providing three-phase electrical power from the power grid. When docked or berthed within a slip equipped with a shore power source, the vessel's shore power cable can be connected to the electrical outlet or cable of the shore power source, providing electricity to the vessel's electrical power system.

Currently, a range of differently configured three-phase sockets are used in marinas throughout the world. IEC 60309, an international standard from the International Electrotechnical Commission for "plugs, socket-outlets and couplers for industrial purposes," sets standards for many industrial three-phase power sockets and plugs One of the purposes of IEC 60309 is to prevent personal injury or death or damage to industrial equipment from improperly connecting industrial equipment or industrial power systems to an electrical power source to which the industrial equipment or industrial power system is not rated, specifically with regards to the voltage, frequency, and amperage of the electrical power source. To accomplish this goal, IEC 60309 provides that plugs differ in their configurations to denote compatible voltage, frequency and amperage ranges and are color coded as such. For example, the diameter of the circular plug housing will designate amperage and the location of the ground pin in relation to the clocking tab (the plastic tab on the outside of the plug housing) denotes voltage and frequency range. The ground pin can be in one of 12 locations in reference to the clocking tab with each location varying by 30 degrees or one hour if the face of the plug is thought of as a clock face with the clocking tab at the 12 o'clock location. Pins of different types of plugs can also differ in diameter and length. For example, a three-phase plug to be used with 50 Hz at 300-500 Volts has a color coded green housing with the ground pin located at the 2 o'clock location or 60 degrees with varying plug housing diameters depending on the amperage for which the plug is designed.

While some of the power sockets found at marinas internationally may follow the IEC 60309 standard, many countries may have their own standard. Generally speaking, though, most three-phase sockets found at marinas internationally will most likely be a four (4) or five (5) pin terminal variety, which have configurations that are similar to IEC 60309 sockets due to having a ground terminal typically larger in diameter than the other terminals, with the neutral terminal (in the case of a five (5) pin socket) being immediately counterclockwise to the ground terminal followed by the L3, L2, and L1 phase terminals. Four (4) pin terminal sockets will not have a neutral terminal, but the order of the phase wire terminals will be the same.

While in practice it would be ideal for sockets at a marina to follow the IEC 60309 standard or another standard based upon the voltage, frequency and amperage of the shore power source, many times the type of socket installed is based upon what was available to the installer at the time of installation. Therefore, one could easily find a 50 V, 300-500 Hz green color coded socket with a ground terminal at 60 degrees having a socket housing with a radius designating 32 amps installed on a shore power source that provides 240 V at 60 Hz with 100 amps. Therefore, prior to connecting the vessel's shore power cable to a shore power source, vessel engineers routinely check the voltage, amperage, and frequency of the shore power source to ensure compatibility with the vessel's electrical power system. While the inventor intends the invention to work primarily with vessels having power converters which have the ability to convert the voltage, frequency, and amperage of any available shore power source to the voltage, frequency, and amperage required by the vessel's electrical power system or systems, the invention could also be used for vessels without power converters as long as proper electrical standards and safety procedures are followed.

Though one may find one shore power socket configuration regularly used throughout a country or region, it is not uncommon for other socket configurations to also be used within that region. For example, there are known shore power source socket configurations that are used in each of the following regions: United States, Europe, Middle East, North Africa, the Caribbean, and South East Asia. One could easily find one of these regional configurations or others being used in a different region.

Typically, a yacht or marine vessel has a shore power cable with a plug having a configuration compatible to the socket configuration of the region where the vessel is manufactured or where the vessel is to be berthed or is currently berthed. When the vessel moves to a marina that uses a different socket configuration from the plug currently installed on the vessel, the typical operating procedure for connecting the vessel to a shore power source at a new marina is: (1) sourcing the correct plug to match the socket provided at that particular location; (2) testing the shore power source socket to determine the correct phase and wire locations; (3) cutting and stripping the vessel's shore power cable and enclosed wires; and (4) installing the sourced plug on the vessel's shore power cable by hard wiring the sourced plug to the vessel's shore power cable wires. There are a number of problems with this procedure. First, sourcing the correct power plug for the location is sometimes very difficult and may take up to a week or longer, requiring the vessel to rely upon its generators for power. Generators are typically loud and therefore frowned upon being used in marinas because no one, including the vessel's owner or its marina neighbors, wants to hear the annoying hum of generators. Second, installing the newly sourced plug can be dangerous if it is wired incorrectly. Third, having to strip the Vessel's expensive power cable every time a new plug is installed shortens the power cable meaning it will eventually need to be replaced when it gets too short. Finally, having to disassemble the vessel's power cable plug every time it docks in a marina having a shore power socket with a different plug configuration creates wear and tear on the power plugs and on the vessel's power cable eventually resulting in one or both needing to be replaced.

In addition, it is not uncommon for marinas to have shore power sources which require the vessel to be hardwired to either a power terminal on the dock or hardwired to the end of a shore power cable which instead of having a socket installed has only bare wires. In these instances, the standard operating procedure is to hard wire the vessel's shore power cable to the marine shore power source following a similar procedure as outlined above.

An alternative operating procedure would involve having multiple cable sets, each of which converts the type of plug configuration installed on the vessel to only one other configuration, thus requiring multiple sets of cables. Each cable set is very expensive and bulky, taking up prime storage space within the vessel. Even if a vessel is equipped with multiple sets of cables, sometimes a vessel will arrive at a marina that has a power plug configuration that is wholly different from any known configuration for which the vessel is equipped, thus requiring the installation of a new power plug following the procedure discussed above.

The present inventor herein has attempted to develop a third option that allows a vessel to be quickly and efficiently connected to a shore power source regardless of whether the configuration of the socket installed on the shore power source, if any, known or unknown.

BRIEF SUMMARY OF THE INVENTION

An object of the present invention is to provide a system for connecting to marine shore power that addresses the needs of supplying a vessel with high amperage three-phase electricity from a shore power source regardless of the "configuration of the shore power source"or the configuration of a socket installed on the shore power source. It is further an object of the present invention to provide a system for connecting to marine shore power to a vessel without the need to use multiple bulky and expensive cable sets or the need to rewire a vessel's shore power cable with a different plug each time the vessel docks in a marina where a different shore power source socket configuration is used.

It is an additional object of the invention to provide a system for connecting to marine shore power that is easy to use, efficient and relatively inexpensive. Additionally still, it is an object of the present invention to provide a system for connecting to marine shore power which accepts a plurality of adapters to connect a vessel to a shore power source by simply plugging an adapter, which is compatible to the socket used on the shore power source, into the vessel's shore power cable plug. Moreover, it is an object of the present invention to provide a system for connecting a vessel's shore power cable to a marine shore power source, having a socket installed with a configuration presently unknown to the inventor, by plugging in an adapter to the vessel's shore power cable plug which is capable of connecting to the shore power source socket.

To achieve the above-mentioned objects, a system for connecting to marine shore power is provided having a vessel plug which accepts a plurality of adapters that each have a unique plug configuration. The vessel plug is intended to replace a vessel's shore power cable plug by installing the vessel plug directly on the vessel's shore power cable. The vessel plug has a male plug component. Each of the plurality of adapters has a female socket component and a male adapter component. The male plug component of the vessel plug is compatible with and plugs into the female socket component of each of the plurality of adapters of the invention. The male adapter components are each configured uniquely to enable vessel's shore power cable to be connected to the shore power source regardless of the configuration of the shore power source or the configuration of the socket, if any, installed on the shore power source.

The majority of the plurality of adapters have configurations matching known four and five pin shore poser socket configurations used internationally. The plurality of adapters and the vessel plug enable the vessel's, electrical system to be connected to the shore power source with a socket installed having one of these known configurations.

At least one or more of the plurality of adapters can connect directly to a three-phase shore power source cable by installing the wires contained within the shore power source cable directly to the male adapter component of the adapter. Instead of the male adapter component having pins which insert into sockets of known configurations, the pins are hollow and can receive and secure the bare wires from a shore power source cable. Being able to receive bare wires gives the adapter the versatility to attach to any shore power source regardless of the configuration of the shore power source or the configuration of a socket installed on the shore power source.

This versatility enables a vessel's electrical system, having a vessel plug of the invention installed on the vessel's shore power cable, to connect to the shore power source in a number of circumstances: (1) including when the shore power source has a cable with no socket installed; (2) when the shore power source has no cable, but rather a power terminal into which the vessel's shore power cable must be hardwired; and (3) when the shore power source has a socket with an unknown configuration, of which, none of the previously mentioned-adapters of the invention are compatible. In the first circumstance the bare wires of the shore power source cable can be installed into the adapter. In the second circumstance a length of shore power cable having a required length can be installed into the adapter with the other end hard wired to the shore power source terminal. In the latter circumstance, a vessel plug meeting the configuration of the unknown socket configuration can be sourced and installed on one end of a length of shore power cable and plugged into the shore power source socket, with the adapter being installed on the other end of the length of shore power cable. In each of these circumstances the vessel plug of the invention installed on the vessel's shore power cable will plug in to the adapter and thereby provide the vessel with electricity.

From this point forward, the adapter, newly sourced vessel plug setup or the adapter cable setup can be saved and used with the system just like any other adapter. It is the intention of the inventor to include two or more of these types of adapters, as a vessel may come across more than one marina having a previously unknown shore power source configuration or a shore power source socket with an unknown configuration.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DETAILED DESCRIPTION OF THE INVENTION

Figure 1:
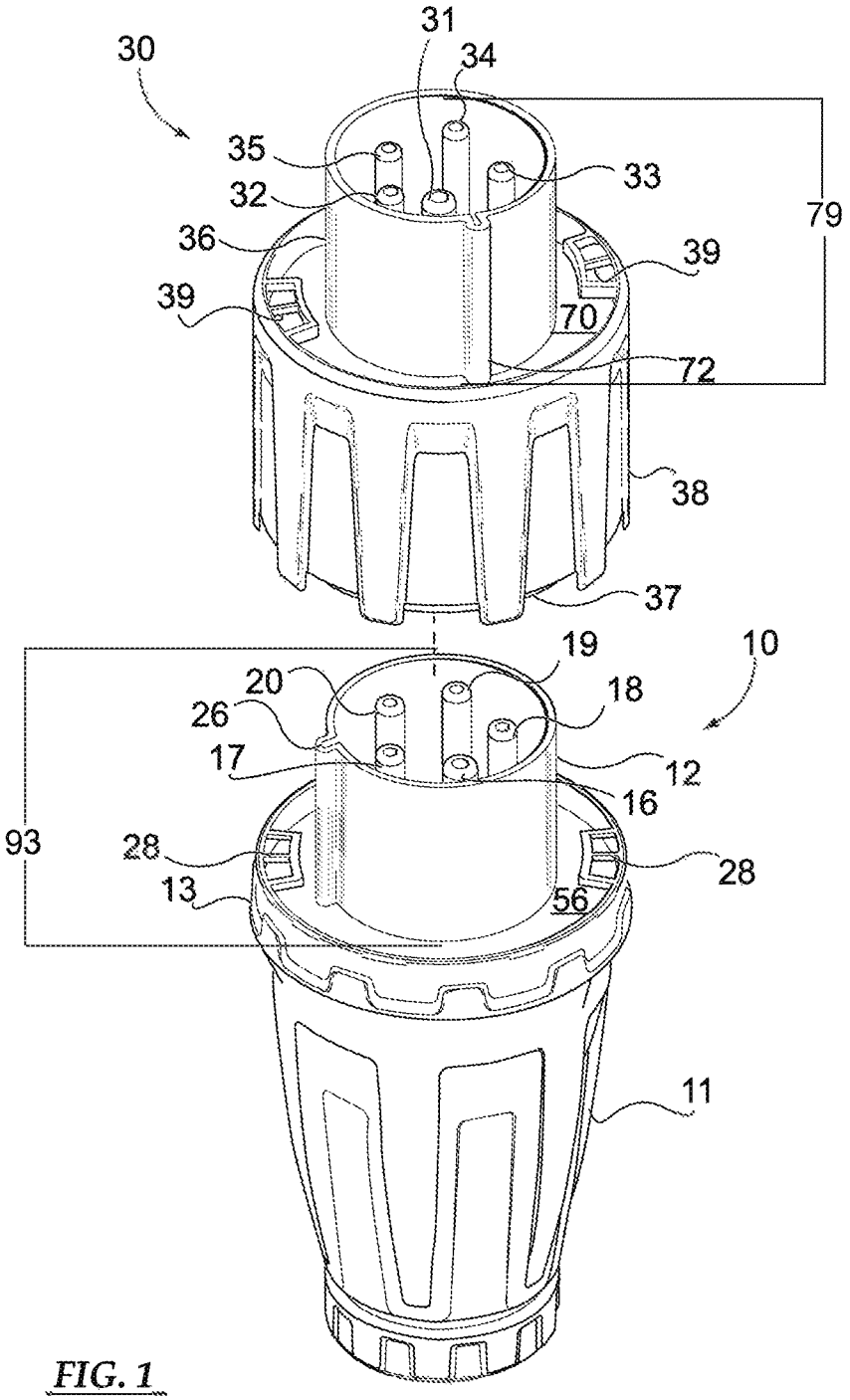
FIG. 1 is a front perspective view illustrating a vessel-side marine shore power plug 10 (hereinafter, simply "vessel plug 10") ready to receive a marine shore power plug adapter 30 (hereinafter simply "adapter 30"), according to an embodiment.

Initially with regards to FIG. 1, a first preferred embodiment of a system for connecting to marine shore power is shown. The system for connecting to marine shore power, as main elements, has a vessel-side marine shore power plug 10 (hereinafter, simply "vessel plug 10") a marine shore power plug adapter 30 (hereinafter, simply "adapter 30"), and an adapter 80, an adapter 100, an adapter 120, an adapter 140, an adapter 160, and a adapter 180 (collectively with adapter 30, hereinafter, simply "plurality of adapters", see FIGS. 5B-5F & FIGS. 6-6B). Vessel plug 10 is intended to be installed on a vessel's shore power cable replacing the plug, if any, installed thereon, if any. Adapter 30 attaches to and is secured on vessel plug 10. Together, vessel plug 10 and adapter 30 and the other plurality of adapters disclosed herein enable the vessel's shore power cable to be connected to a shore power source regardless of the configuration of the shore power source or the configuration of a socket (hereinafter referred to as "shore power source socket") installed thereon, if any. Unless otherwise stated, the majority of the components of vessel plug 10 in this embodiment are made from injection molded glass filled polypropylene, polymer or copolymer plastic which is flame retardant, heat resistant, non-conductive and has good impact resistance, tensile strength and toughness. The exterior components of vessel plug 10 may also have a rubber coating for an easier grip. Other embodiments may use similar materials known in the art having similar qualities.

Figure 2:
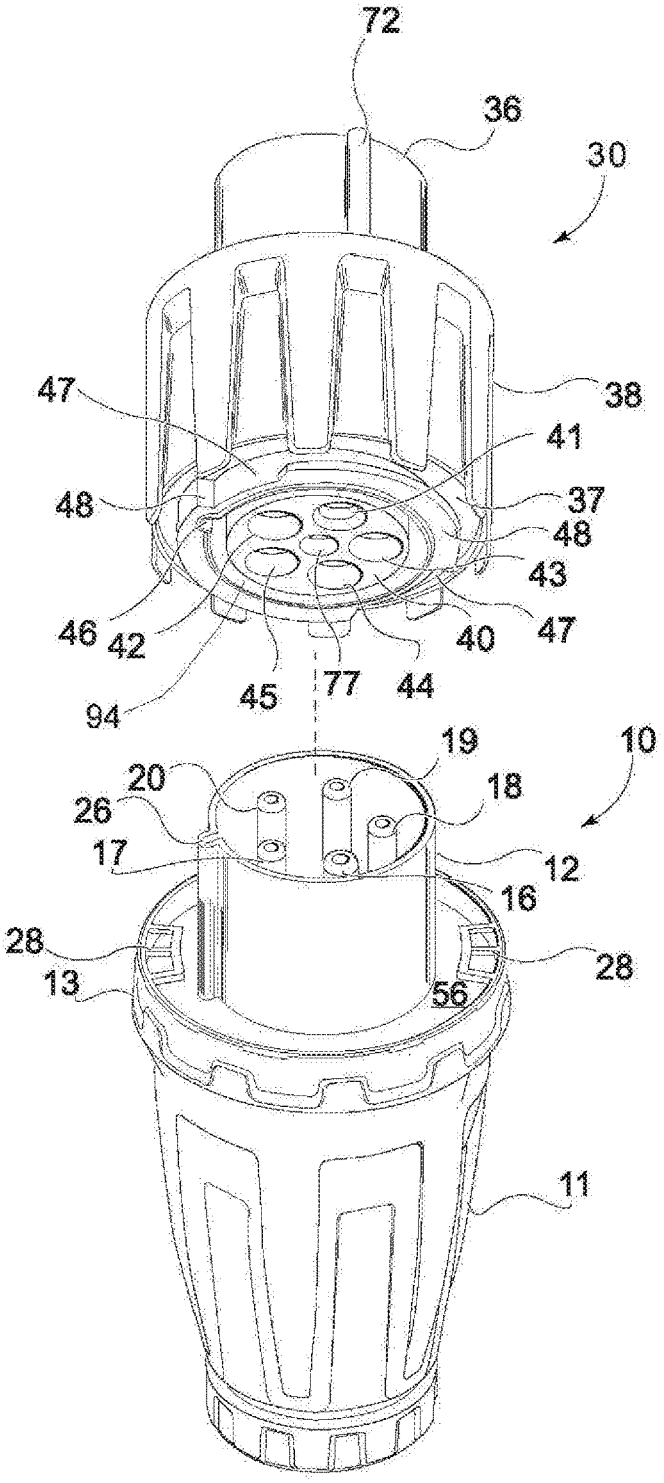
FIG. 2 is a front perspective view illustrating the male plug component of the vessel plug of FIG. 1 and the receiving female socket component of the adapter of FIG. 1, according to an embodiment.

With reference to FIG. 1, a lock ring 13, having locking tabs 28, is attached to a housing 11. Lock ring 13 can freely rotate about the center axis of housing 11. When adapter 30 and vessel plug 10 are attached, lock ring 13 with locking tabs 28 secures adapter 30 to vessel plug 10. A terminal block 12 (only portion of which is shown in FIGS. 1 and 2) is also attached to housing 11. ( See FIG. 3 which shows all individual components of terminal block 12 within the bracket, excepting therefrom lock ring 13). Terminal block 12 has a top portion and a bottom portion with only the top portion being shown in FIG. 1. The bottom portion of terminal block 12 (comprised of those components within the bracket located below lock ring 13 as shown in FIG. 3) is enclosed within housing 11 which is shown in FIGS. 3 and 4.

Figure 3:
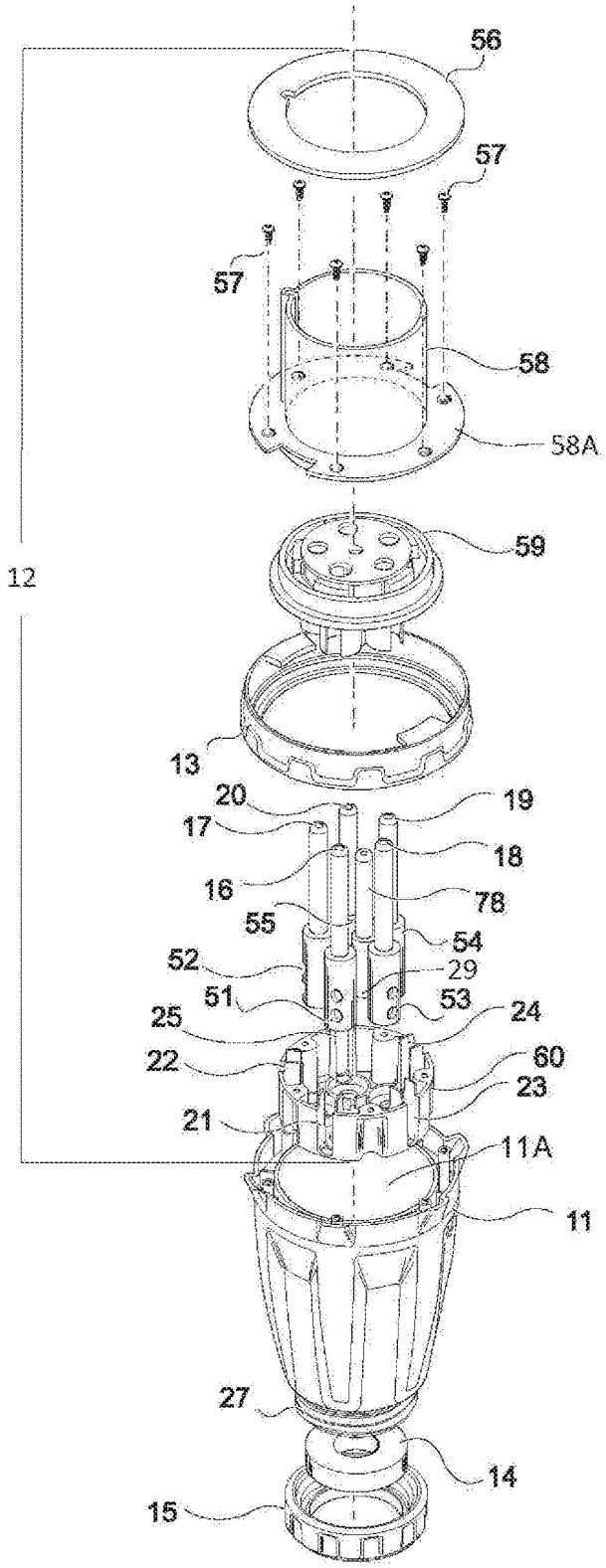
FIG. 3 is an exploded perspective view diagram illustrating the vessel plug of FIG. 1, according to an embodiment.
Figure 4:
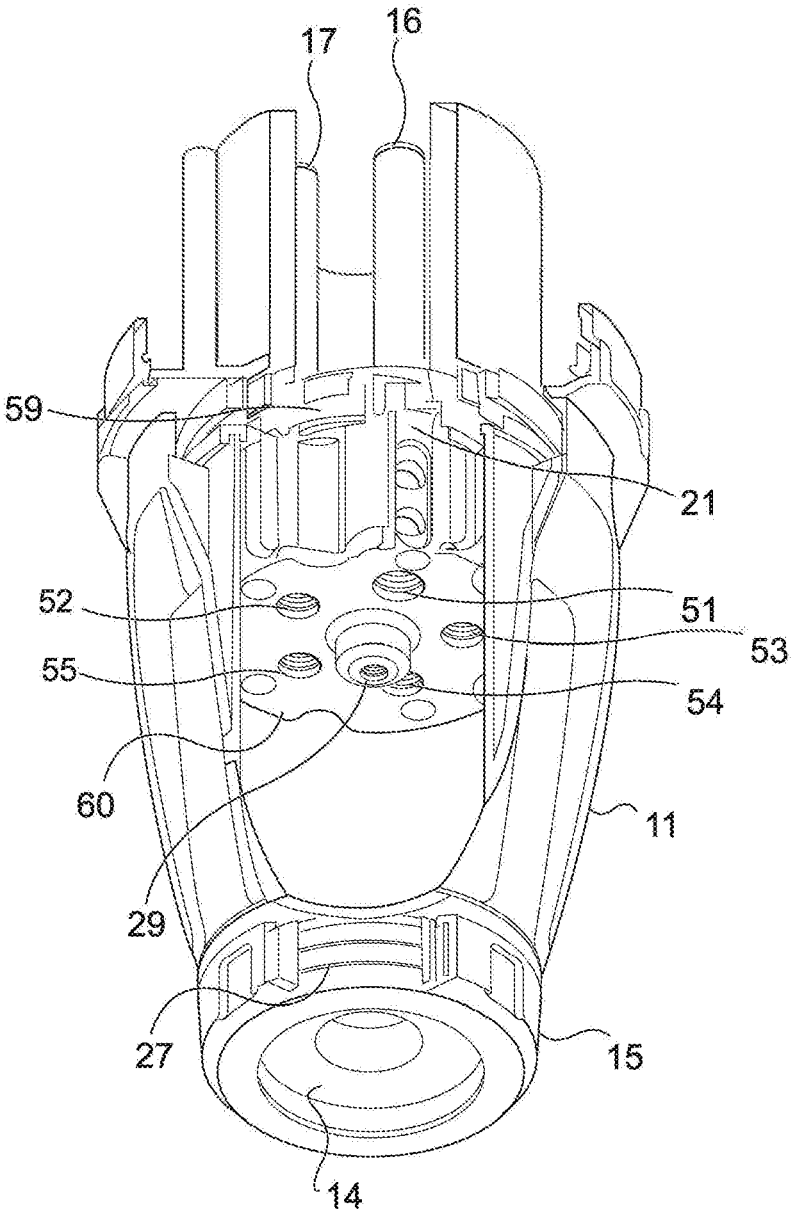
FIG. 4 is a diagram illustrating a front side cross section view of the vessel plug of FIG. 1.

Further with regards to FIG. 1, the top portion of terminal block 12(comprised of those components within the bracket located above lock ring 13 as shown in FIG. 3) comprises a circular plug housing 58 (see FIG. 3) having a flange 58A (See in FIG. 3) extending circumferential from its bottom outer surface. The circular plug housing 58 also has an alignment tab 26 which extends axially from its outer surface. The circular plug housing 58 encloses each of a first end piece of a ground pin 16, a neutral pin 17, an L1 phase pin 18, an L2 phase pin 19, an L3 phase pin 20 (hereinafter simply "pins 16, 17, 18, 19, and 20") and a pilot contact 78 see FIG. 3). Together, with circular plug housing 58, the first end pieces of pins 16 through 20 and the first end piece of pilot contact 78 make up a male plug component 93 of vessel plug 10. The first end piece of pilot contact 78 is in the center of the male plug component 93 for safely grounding vessel plug 10 when vessel plug 10 is inserted into adapter 30 or any of the plurality of adapters. A second end piece of each of pins 16 through 20 and a second end piece of pilot contact 78 are enclosed in the bottom portion of the terminal block 12, which is shown in FIGS. 3 and 4. In this embodiment, Pins 16 through 20 and pilot contact 78 are comprised of stainless steel which is highly conductive and has non-corrosive properties to prevent them from corroding in a salt water marine environment. In other embodiments pins 16 through 20 and pilot contact 78, could be made out of similar materials known in the art having similar conductive and non-corrosive properties.

Additionally with regards to FIG. 1, a gasket 56 is shown encircling the top portion of terminal block 12 and sitting on flange. In this embodiment gasket 56 is comprised of silicone or similar material known in the art which is non-conductive and can endure the heat produced by the electricity from a high amperage shore power source going through vessel plug 10 while in use. When adapter 30, or another embodiment of adapter 30, is attached and secured to vessel plug 10, gasket 56 is compressed between flange 58A and adapter 30, thereby creating a water proof seal, preventing moisture from entering housing 11 where terminal block 12 is attached thereto or entering through the bottom of adapter 30. Other embodiments may employ a similar means known in the art to water proof vessel plug 10 and adapter 30.

In other embodiments, vessel plug 10 may also incorporate additional features of electrical connectors known in the art. Also, in other embodiments vessel plug 10 could have plug configurations that vary with respect to: diameter and depth of circular plug housing 58, location of ground pin in reference to the alignment tab 26, pin size and length, number and location of pins, use of a pilot contact, and amperage, voltage, and frequency specifications to match and connect directly to the shore power source having a known or unknown configuration, without the use of an adapter.

Further with regards to FIG 1, adapter 30 is shown. Adapter 30 has a male adapter component 79 compatible with the configuration of a first variation of a socket regularly, but not exclusively, used at marinas in Europe ("European Socket-V1"). Unless otherwise stated, the majority of the components of adapter 30 in this embodiment, like those of vessel plug 10, are made from injection molded glass filled polypropylene, polymer or copolymer plastic which is flame retardant, heat resistant, non-conductive and has good impact resistance, tensile strength and toughness. The exterior components may also have a rubber coating for an easier grip. Other embodiments of the invention may use other materials known in the art having similar qualities. An adapter lock ring 38, having locking tabs 39, is shown attached to and mostly enclosing an adapter terminal block 37 and minimally enclosing an adapter housing 36. Lock ring 38 can freely rotate about the center axes of adapter terminal block 37 and adapter housing 36.

Adapter 30 is additionally comprised of an adapter ground pin 31, an adapter neutral pin 32, an adapter L1 phase pin 33, an adapter L2 phase pin 34, an adapter L3 phase pin 35 (hereinafter, simply "adapter pins 31, 32, 33, 34, and 35"), and an adapter pilot contact 74 (see FIG. 5). In this embodiment, adapter pins 31 through 35 and adapter pilot contact 74 are comprised of stainless steel which is highly conductive and has non-corrosive properties to prevent them from corroding in a salt water marine environment. In other embodiments of the invention, pins 31 through 35 and adapter pilot contact 74 could be made out of similar materials known in the art having similar conductive and non-corrosive properties. Adapter pins 31 through 35 and adapter pilot contact 74 each have a first end portion and a second end portion, shown respectively as second end portions 61 through 65 and 92. Each first end portion of adapter pins 31 through 35 and adapter pilot contact 74 are separated by a shoulder 66 from second end portions 61 through 65 and 92. The first end portions of adapter pins 31 through 35 and adapter pilot contact 74 are enclosed within adapter housing 36. Together, with adapter housing 36, the first end portions of adapter pins 31 through 35 and adapter pilot contact 74 make up male adapter component 79. The first end portion of adapter pilot contact 74, is located in the center of male adapter component 79 for safely grounding adapter 30 when it is plugged into the shore power source socket. Second end portions 61 through 65 and 92 have hollow cavities to receive spring contacts 71 followed by the first end piece of respective pins 16 through 20 and pilot contact 78, creating an electrical connection between each second end portion 61 through 65 and 92 and each respective first end piece of pins 16 through 20 and pilot contact 78. Each of the second end portions 61 through 65 and 92 are enclosed within adapter terminal block 37, with the ends of each second end portion protruding into cylindrical recesses 76 through to the bottom of adapter terminal block 37. Adapter pins 31 through 35 and adapter pilot contact 74 each have first end portions and second end portions having axes which are aligned. However, in other embodiments the first end portions and second end portions thereof may have axes which are offset from one another.

Further with regards to the embodiment shown in FIG. 1, adapter housing 36 has a clocking tab 72 extending axially from its outer surface. In addition, adapter housing 36 has a flange 36A extending circumferential from its bottom outer surface on which a gasket 70 sits. In this embodiment, gasket 70 is comprised of silicone or a similar material known in the art which is non-conductive and can withstand heat that may develop within adapter 30 as a result of the transfer of electricity from the shore power source through adapter 30 to the vessel's shore power cable when under load. To connect adapter 30 to the European Socket-V1, the male adapter component is inserted into the European Socket-V1. Tightening lock ring 38 results in locking tabs 39 engaging and pulling corresponding lock plates on the European Socket-V1 axially in the direction of adapter 30. When adapter 30 is attached to the European Socket-V1, gasket 70 is compressed between the flange 36A and the shore power source socket, thereby creating a water proof seal, keeping moisture out of adapter 30 and away from adapter pins 31 through 35 and or the corresponding terminals of the shore power source socket. Other embodiments may employ other means known in the art to water proof adapter 30.

Initially with regards to FIG. 2, a bottom perspective view of adapter 30 and its components is shown. The bottom of adapter terminal block 37 is shown to have a female socket component 40 surrounded by a circular recess 94 having an alignment channel 46. Female socket component 40, circular recess 94, and alignment channel 46 receive circular plug housing 58 and alignment tab 26, respectively. Female socket component 40 is further comprised of an adapter ground terminal 41, an adapter neutral terminal 42, an L1 adapter phase terminal 43, an L2 adapter phase terminal 44, an L3 adapter phase terminal 45, and a pilot contact terminal 77 (hereinafter, simply "adapter terminals 41, 42, 43, 44, 45, and 77"). Adapter terminals 41 through 45 and 77 are each comprised of cylindrical recesses 76 and the hollow cavities of second end portions 61 through 65 and 92. Adapter terminals 41 through 45 and 77 receive pins 16 through 20 and pilot contact 78 when adapter 30 is attached to vessel plug 10, creating an electrical connections between respective pins and pilot contacts of adapter 30 and vessel plug 10.

Further with regards to FIG. 2, lock plates 48, diametrically opposite to each other, extend semi-circumferentially and perpendicularly from the outer surface of terminal block 37 nearest the bottom of terminal block 37. Each lock plate 48 has a first end and a second end, which are diametrically opposite from the respective first end and second end of other lock plate 48. Each lock plate 48 has a ramp increasing clockwise in height from its first end to its second end. Abutting the second end of each lock plate 48 is a tab having a vertical height approximately twice the vertical height of the second end of each lock plate 48. Each tab which extends radially from the outer surface of the adapter terminal block so that the outer radial surface of each tab is flush with the outer radial surface of each lock plate 48. Notches 47 are shown as the arc spaces along the outer surface of terminal block 37 between the first end of each lock plate 48 and the tab abutting the second end of the other lock plate 48.

To insert vessel plug 10 into adapter 30, insert male plug component 93 into circular recess 94 of female socket component 40, while simultaneously aligning alignment tab 26 with alignment channel 46 and locking tabs 28 with notches 47. Doing so will result in pins 16 through 20 and pilot contact 78 inserting into adapter terminals 41 through 45 and 77 and therefore into the second end portions 61 through 65 and 92 of pins 31 through 35 and adapter pilot contact 74. To secure adapter 30 onto vessel plug 10, press adapter 30 onto vessel plug 10 and rotate lock ring 13 so that the bottom surface of each locking tab 28 slides along the top surface of each lock plate 48 from its first end to its second end until each locking tab 28 is stopped by the tab abutting the second end of each lock plate 48. Rotating lock ring 13 pulls adapter 30 towards vessel 10 fully seating adapter 30 onto vessel plug 10. Attaching adapter 30 to vessel plug 10 and locking with lock ring 13 creates electrical connections between pins 16 through 20 of vessel plug 10 and respective terminals 41 through 45 of adapter 30 and also between pilot contact 78 and adapter pilot contact 74. Other ways known in the art to attach and secure adapter 30 to vessel plug 10 could be used in other embodiments. Once adapter 30 is secured to vessel plug 10, the vessel's shore power cable can be connected to the shore power source by inserting male adapter component 79 into the shore power source socket, providing the vessel with electrical power.

In this embodiment, each of the plurality of adapters, vary with respect to: the diameter, thickness and depth of the adapter housing; diameter, length, location and number of adapter pins; use of a neutral adapter pin; location of ground pin in relation to clocking tab; use of a pilot contact; number of phases; and amperage, voltage, and frequency specifications resulting in each of the plurality of adapters having a unique configuration to be compatible with the shore power source socket having a known configuration. Each of the plurality of adapters have a unique configuration compatible with shore power source sockets having configurations regularly used in Europe, the Middle East, North Africa, the Caribbean, or South East Asia; shore power source sockets with configurations based upon national, regional, or international standards; and shore power source sockets with other configurations. The plurality of adapters allow the vessel's shore power cable to be connected to the shore power source regardless of the configuration of the shore power source of the shore power source socket, if any, installed thereon. See FIGS. 5B through 5F and FIGS. 6 through 6B for examples of the plurality of adapters having unique configurations which vary from the configuration of adapter 30.

Initially with regards to FIG. 3, an exploded perspective view of vessel plug 10 of the first preferred embodiment is shown. Terminal block 12 shown in FIGS. 1 and 2 is shown here as three separate components: circular plug housing 58; receptacle 59; and wiring cover 60. The second end pieces of pins 16 through 20 and pilot contact 78 are enclosed within terminal block 12. In other embodiments terminal block 12 may be comprised of one or more separate components. The second end pieces of pins 16 through 20 are shown as respective terminals 51, 52, 52, 54, and 55. terminals 51, 52, 53, 54, and 55. The second end piece of pilot contact 78 is shown as terminal 29. In this embodiment, terminals 51 through 55 and 29 are hollow in order to receive wires from the vessel's shore power cable. Terminals 51 through 55 and 29 also have a means for holding the vessel's shore power cable wires in place, which in this embodiment are two threaded holes perpendicular to the length of each pin 16 through 20 and pilot contact 78 that receive set screws. When seated, the set screws pinch the wires of the vessel's shore power cable against the inside radial surface of terminals 51 through 55 and 29 creating an electrical connection between the vessel's shore power cable wires and the respective pins 16 through 20 and pilot contact 78. In other embodiments, different means known in the art could be used to hold the vessel's shore power cable wires in place and/or to create the electrical connections.

Terminals 51 through 55 are each enclosed within a respective recess 21, 22, 23, 24, and 25 created by joining the bottom of receptacle 59 and the top of wiring cover 60. Terminal 29 is also enclosed within the joined receptacle 59 and wiring cover 60. When terminal block 12 is fully assembled, with pins 16 through 20 and pilot contact 78 enclosed therein, the hollow cavities of terminals 51 through 55 and terminal 29 are accessible through holes in the bottom of wiring cover 60, with the set screws of terminals 51 through 55 being accessible through recesses 21 through 25. The set screws of terminal 29 are accessible through the side of wiring cover 60 (not shown).

Further with regards to FIG. 3, the bottom portion of terminal block 12, consisting of wiring cover 60, receptacle 59, and enclosed terminals 51 through 55 and 29, inserts into housing 11 through an opening 11A of housing 11. Flange 58A has a plurality of holes through which screws 57 secure terminal block 12 to housing 11. Gasket 56 sits on top of flange 58A, covers screws 57, and is compressed when vessel plug 10 is inserted into and secured to adapter 30 or any of the plurality of adapters, creating a waterproof seal over screws 57 and around circular plug housing 58. Additionally with regards to FIG. 3, housing 11 has a receiving end 27 having an internally recessed bevel which creates a cylindrical pocket to receive a smash seal 14. Receiving end 27 has threading to receive a compression nut 15 having complementary threading thereto. Threading compression nut 15 onto receiving end 27, with smash seal 14 seated within the cylindrical pocket and the vessel's shore power cable inserted into smash seal 14 and installed within housing 11 and to terminal block 12, compresses smash seal 14 into the cylindrical pocket and around the vessel's shore power cable creating waterproof seals keeping water and moisture from penetrating housing 11 through receiving end 27. Other embodiments of the invention could use one or more of the various other forms of waterproofing known in the art to ensure vessel plug 10 is waterproof or water resistant.

FIG.4 is an internal view illustrating the bottom portion of terminal block 12 (receptacle 59 and wiring cover 60) inserted into opening 11A of housing 11, with the top portion of terminal block 12 (circular plug housing 58) secured to housing 11. More specifically FIG. 4 illustrates the second end pieces of pins 16 through 20 and pilot contact 78 (terminals 51 through 55 and 29) enclosed within respective recesses 21 through 25 (only recess 21 is shown in FIG 4). The set screws and hollow cavities of terminals 51 through 55 and 29, as described above, are visible by example in recess 21, which when utilized receive and secure the vessel's shore power cable wires. Additionally, compression nut 15 is shown threaded onto receiving end 27, which compresses smash seal 14 into the cylindrical pocket of receiving end 27. Pilot contact terminal 29 is shown in the center of wiring cover 60 and encloses the second end piece of pilot contact 78.

Figure 5:
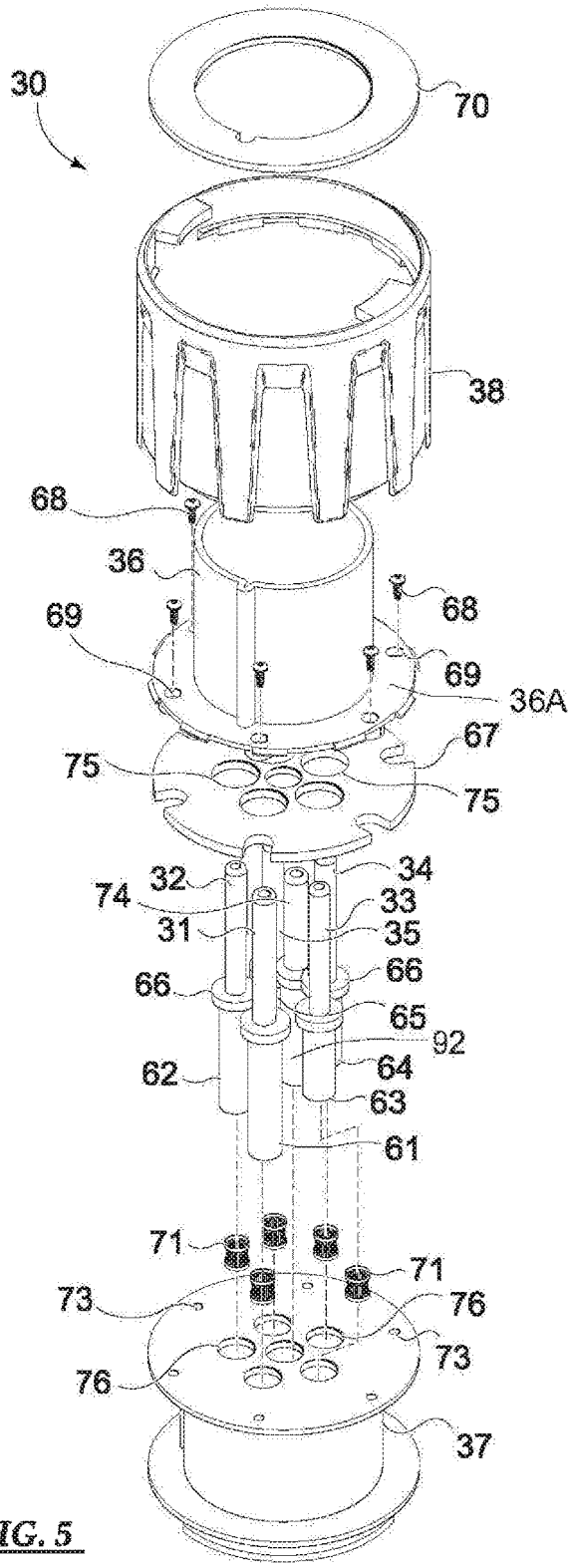
FIG. 5 is an exploded perspective view diagram of adapter 30 having a plug configuration that is a first variation of a plug regularly, but not exclusively, used in Europe, according to an embodiment.

Initially with regards to FIG. 5, an exploded perspective view of adapter plug 30 of the first preferred embodiment is shown. The hollow cavities of second end portions 61 through 65 and 92 receive spring contacts 71. When the first end pieces of pins 16 through 20 and pilot contact 78 are inserted into second end portions 61 through 65 and 92, spring contacts 71 compress, pushing axially against the inside circular surface of each second end portion and the end surfaces of the first end pieces of pins 16 through 20, creating an electrical connection therebetween. Adapter pins 31 through 35 have shoulders 66 separating their first and second end portions. Adapter terminal block 37 has cylindrical recesses 76 which receive respective second end portions 61 through 65 and 92. An adapter pin plate 67 has shoulder holes 75 which receive shoulders 66 of pins 31-35 and adapter pilot contact 74. Adapter pin plate 67 sits on top of adapter terminal block 37. Adapter housing 36 sits on top of adapter pin plate 67, enclosing the first end portions of adapter pins 31 through 35 and the first end portion of pilot contact 74. Screws 68 are shown, which are received by holes 69 in adapter housing 36 and received by threaded holes 73 in adapter terminal block 37. Inserting screws 68 through adapter housing 36 and adapter pin plate 67 and tightening into holes 73 secures adapter housing 36 and adapter pin plate 67 to adapter terminal block 37, enclosing the first end portions of adapter pins 31 through 35 and adapter pilot contact 74 within adapter housing 36 and securing second end portions 61 through 65 and 92 within cylindrical recesses 76 of adapter terminal block 37. Gasket 70 sits on top of screws 69 and holes 68 and is compressed when adapter 30 is inserted into and secured to the shore power source socket, creating a waterproof seal over screws 69, holes 68 and around housing 36. Lock ring 38 attaches to and mostly encloses adapter terminal block 37 and minimally encloses adapter housing 36. Lock ring 38 can freely rotate about the center axes of adapter terminal block 37 and adapter housing 36.

Figure 5A:
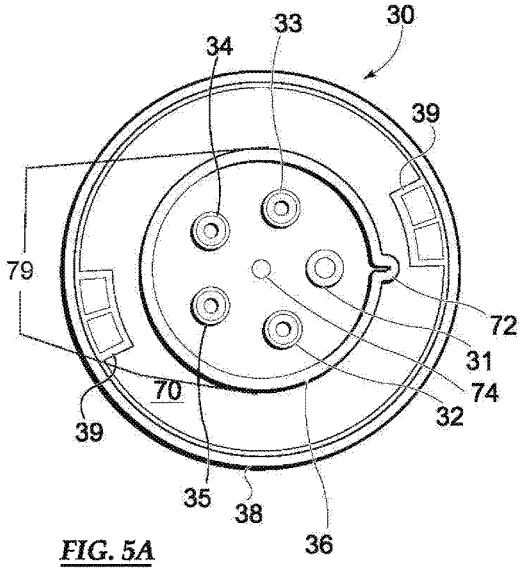
FIG. 5A is a top plan view of adapter 30 having a plug configuration that is a first variation of a plug regularly, but not exclusively, used in Europe, according to an embodiment.

FIG. 5A depicts a top plan view of adapter 30. FIG. 5A shows adapter pilot contact 74 in the center of the male adapter component 79. Attaching adapter 30 to vessel plug 10 allows the vessel's shore power cable to be connected to the shore power source when the European Socket-V1 is installed on the shore power source.

Adapters 80, 100, 140, 160, and 180, as shown in FIGS. 5B through 5F below, are adapters having alternative configurations to adapter 30 and are primarily comprised of the same components as adapter 30. The alternative configurations of adapters 80, 100, 120, 140, 160, and 180 are specifically designed to match shore power source sockets having specific configurations. Each of these adapter configurations may vary with respect to: the diameter, thickness and depth of adapter housing; location, size, length, diameter and number of adapter pins; use or nonuse of an adapter neutral pin; and location of the adapter ground pin in relation to the clocking tab. In other embodiments, alternative adapter configurations could also vary with respect to: whether an adapter pilot contact is used; number of phases; and amperage, voltage, and frequency specifications.

Figure 5B:
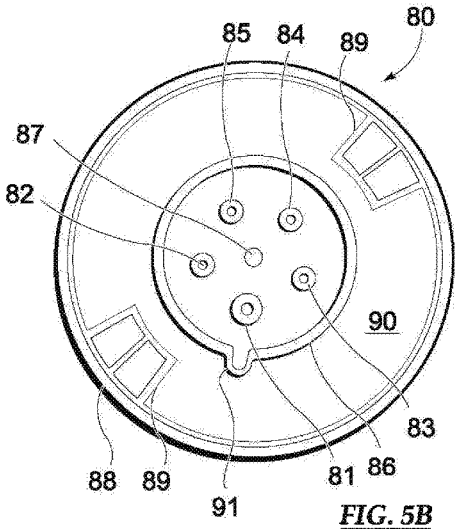
FIG. 5B is a top plan side view of an adapter having a plug configuration that is regularly, but not exclusively, used in the Middle East, Europe and South East Asia, according to an embodiment.

FIG. 5B depicts a top plan view of adapter 80, which has a male adapter component configuration matching a shore power source socket configuration that is regularly, but not exclusively, used at marinas in the Middle East, Europe and South East Asia. Attaching adapter 80 to vessel plug 10 allows the vessel's shore power cable to be connected to the shore power source having a shore power source socket installed thereon compatible to adapter 80. Adapter 80 comprises an adapter ground pin 81, an adapter neutral pin 82, an L1 adapter phase pin 83, an L2 adapter phase pin 84, an L3 adapter phase pin 85, and a pilot contact 87. Adapter 80 further comprises an adapter housing 86 having a clocking tab 91, a gasket 90, and a lock ring 88 having locking tabs 89.

Figure 5C:
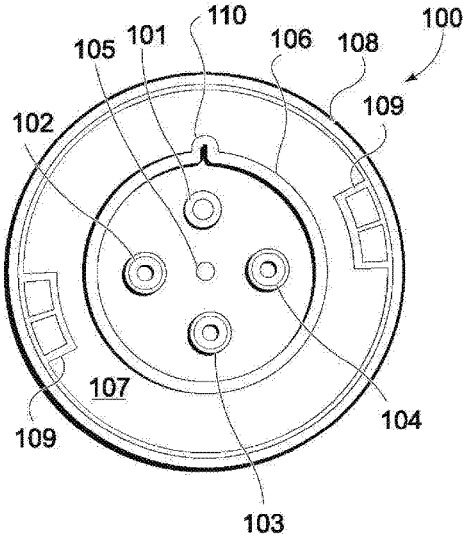
FIG. 5C is a top plan view of an adapter having a plug configuration that is regularly, but not exclusively, used in France and North Africa, according to an embodiment.

FIG. 5C depicts a top plan view of adapter 100 which has a male adapter component configuration matching a shore power source socket configuration that is regularly, but not exclusively, used at marinas in France and North Africa. Attaching adapter 100 to vessel plug 10 allows the vessel's shore power cable to be connected to the shore power source having a shore power source socket installed thereon compatible to adapter 100. Adapter 100 is comprised of an adapter ground pin 101, an L1 adapter phase pin 102, an L2 adapter phase pin 103, an L3 adapter phase pin 104, and a pilot contact 105. Adapter 100 further comprises an adapter housing 106 having a clocking tab 110, a gasket 107, and a lock ring 109 having locking tabs 109. Adapter 100 does not have an adapter neutral pin, as the shore power source socket configuration adapter 100 is compatible with does not have a neutral terminal.

Figure 5D:
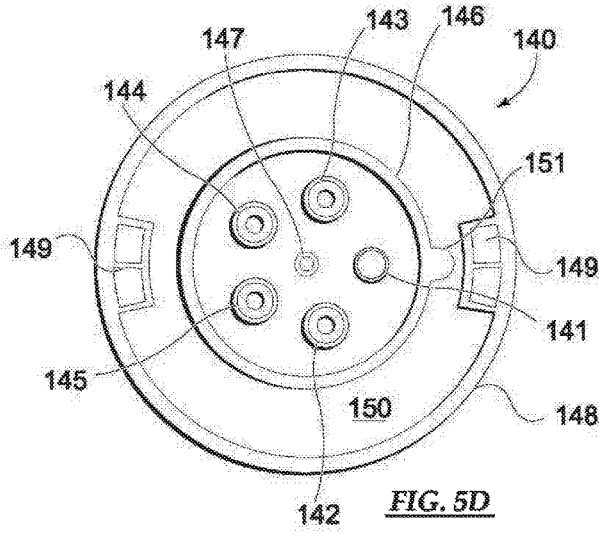
FIG. 5D is a top plan view of an adapter having a plug configuration that is regularly, but not exclusively, used in Europe, the Middle East, and the Caribbean, according to an embodiment.

FIG. 5D depicts a top plan view of adapter 140 which has a male adapter component configuration matching a shore power source socket configuration that is regularly, but not exclusively, used at marinas in Europe, the Middle East, and the Caribbean. Attaching adapter 140 to vessel plug 10 allows the vessel's shore power cable to be connected to the shore power source having a shore power source socket installed thereon compatible to adapter 140. Adapter 140 comprises an adapter ground pin 141, an adapter neutral pin 142, an L1 adapter phase pin 143, an L2 adapter phase pin 144, an L3 adapter phase pin 145, and a pilot contact 147. Adapter 140 further comprises an adapter housing 146 having a clocking tab 151, a gasket 150, and a lock ring 148 having locking tabs 149.

Figure 5E:
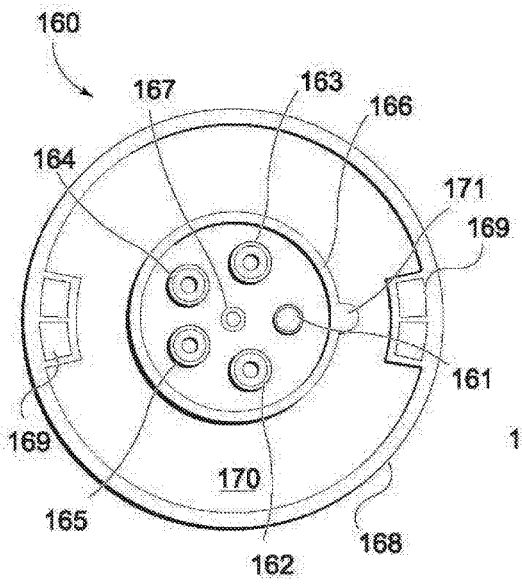
FIG. 5E is a top plan view of an adapter having a plug configuration that is a second variation of a plug regularly, but not exclusively, used in Europe, according to an embodiment.

FIG. 5E depicts a top plan view of adapter 160 which has a male adapter component configuration matching a shore power source socket having a configuration that is a second variation of a plug regularly, but not exclusively, used in Europe. Attaching adapter 160 to vessel plug 10 allows the vessel's shore power cable to be connected to the shore power source having a shore power source socket installed thereon compatible to adapter 160. Adapter 160 comprises an adapter ground pin 161, an adapter neutral pin 162, an L1 adapter phase pin 163, an L2 adapter phase pin 164, an L3 adapter phase pin 165, and a pilot contact 167. Adapter 160 further comprises an adapter housing 166 having a clocking tab 171, a gasket 170, and a lock ring 168 having locking tabs 169.

Figure 5F:
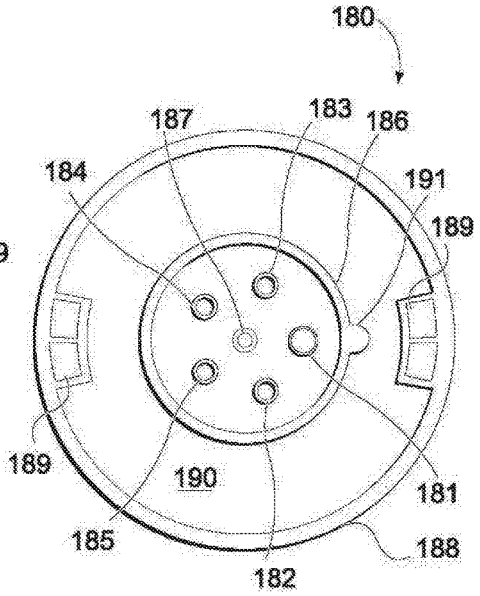
FIG. 5F is a top plan view of an adapter having a plug configuration that is regularly, but not exclusively, used in the United States, according to an embodiment.

FIG. 5F depicts a top plan view of adapter 180 which has a male adapter component configuration matching a shore power source socket configuration that is regularly, but not exclusively, used at marinas in the United States. Attaching adapter 180 to vessel plug 10 allows the vessel's shore power cable to be connected to the shore power source having a shore power source socket installed thereon compatible to adapter 180. Adapter 180 comprises an adapter ground pin 181, an adapter neutral pin 182, an L1 adapter phase pin 183, an L2 adapter phase pin 184, an L3 adapter phase pin 185, and a pilot contact 187. Adapter 180 further comprises an adapter housing 186 having a clocking tab 191, a gasket 190, and a lock ring 188 having locking tabs 189.

In other embodiments, alternative adapters will be included having male adapter component configurations that vary with respect to: the diameter, thickness and depth of adapter housing; location, size, length, diameter and number of adapter pins; use or nonuse of an adapter neutral pin; and location of the adapter ground pin in relation to the clocking tab. These alternative adapters will also vary with respect to: whether an adapter pilot contact is used; number of phases; and amperage, voltage, and frequency specifications.

Figure 6:
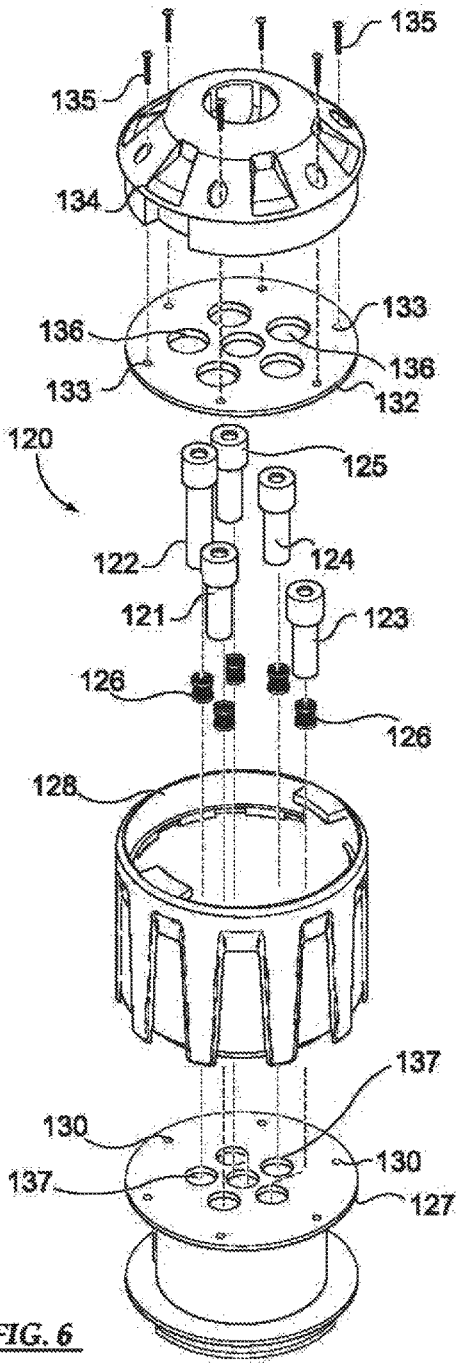
FIG. 6 is an exploded perspective view of an adapter which can receive wire leads enabling the adapter to be attached to a shore power source regardless of the shore power source configuration or the configuration of any socket installed on the shore power source cable.

FIG. 6 depicts adapter 120. Adapter 120 is meant to be installed on vessel plug 10 in those instances when the vessel docks at a marina where none of the previously mentioned adapters (Adapters 30, 80, 100, 140, 160, and 180) will match the configuration of the shore power source socket available to the vessel. Adapter 120 has an adapter ground pin 121, an adapter neutral pin 122, an L1 adapter phase pin 123, an L2 adapter phase pin 124, and an L3 adapter phase pin 125 (hereinafter, "adapter pins 121 through 125") having first end portions with each having a cavity to receive and secure the respective ground, neutral, and L1, L2, and L3 phase wire from a three-phase electrical cable, creating an electrical connection between each first end portion and the respective wire of the three-phase electrical cable. In this embodiment, the wires of the three-phase electrical cable can be secured within adapter pins 121 through 125 with solder. In other embodiments, other means known in the art would be used to secure the wires within adapter pins 121 through 125.

Further with regards to FIG. 6, the second end portions of adapter pins 121 through 125 are just like adapter pins 31 through 35 having hollow cavities to receive the first end pieces of pins 16 through 20. Here, spring contacts 126 insert into the second end portions of adapter pins 121 through 125 and when followed by the insertion of pins 16 through 20, creating an electrical connection therebetween. The second end portions of adapter pins 121 through 125 insert into adapter terminal block 127. An adapter pin plate 132 has holes 136 which receive the first end portions of adapter pins 121 through 125. Adapter pin plate 132 sits on top of adapter terminal block 127 enclosing the second end portions of pins 121 through 125 within adapter terminal block 127. An adapter cover 134 sits on top of adapter pin plate 132 enclosing the first end portions of pins 121 through 125 therein. Screws 135 are shown, which are received by holes in adapter cover 134, holes 133 in adapter pin plate 132 and threaded holes 130 in adapter terminal block 127. Inserting screws 135 through adapter cover 134 and adapter pin plate 132 and tightening them into holes 130 secures adapter cover 134 and adapter pin plate 132 to adapter terminal block 127, enclosing the first ends of adapter pins 121 through 125 within adapter cover 134 and securing second end portions of adapter pins 121 through 125 within adapter terminal block 127. Lock ring 128 attaches to and mostly encloses adapter terminal block 127. Lock ring 128 can freely rotate about the center axis of adapter terminal block 127.

Figure 6A:
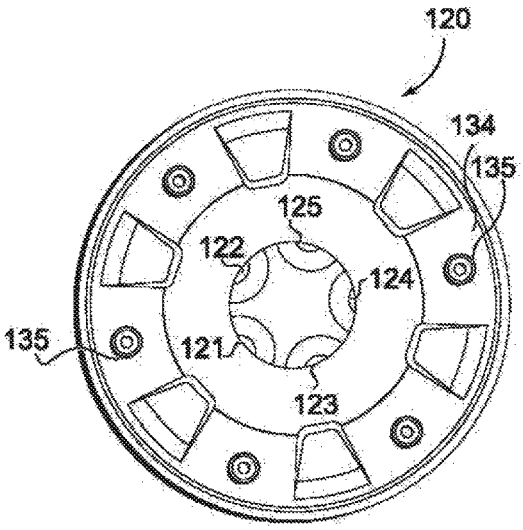
FIG. 6A is a top plan view of an adapter which can receive wire leads as shown in FIG. 6.

FIG. 6A shows a top plan view of adapter 120. Screws 135 are shown securing adapter cover 134 to adapter terminal block 127, with adapter 134 enclosing the first end portions of adapter pins 121 through 125.

Figure 6B:
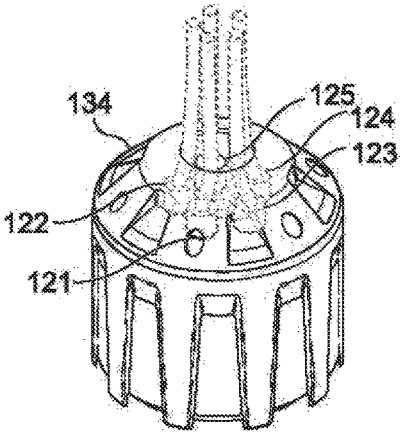
FIG. 6B is a front perspective view of an adapter which can receive wire leads as shown in FIGS. 6 and 6A.

FIG. 6B shows a front perspective view of adapter 120, illustrating what adapter 120 would look like with the wires of the three-phase electrical cable installed within adapter 120. The wires of the three-phase electrical cable are shown inserted through a center hole of adapter cover 134 and into adapter pins 121 through 125.

Adapter 120 can be used in instances when the shore power source has a three-phase electrical cable with no shore power source socket installed. Simply install adapter 120 directly onto the bare wires of the three-phase electrical cable of the shore power source. Adapter 120 can additionally be used in instances where the shore power source socket has a configuration that isn't compatible with any of the adapters 30, 80, 100, 140, 160, or 180. In such an instance, a plug that is compatible with the shore power source socket configuration can be sourced and connected to the male adapter component of adapter 120 by connecting one end of a section of three-phase electrical cable to the male adapter component of adapter 120 as discussed above and installing the newly sourced plug onto the other end of the section of three-phase electrical cable. Lastly, adapter 120 can be connected to the shore power source in instances where the shore power source has no cable, but only a terminal that receives bare wires. In such an instance one end of the section of three-phase electrical cable can be connected to adapter 120, with the other end of the section of three-phase electrical cable connected to the shore power source terminal.

From this point forward: adapter 120 having the sourced plug installed thereon with the section of three-phase electrical cable; or adapter 120 with the three-phase electrical cable installed thereon can be used with the system just like any of the plurality of adapters. It is the intention of the inventor for the System and Method for Connecting to Marine Shore Power to include two or more of adapter 120 as the vessel may come across more than one marina where the shore power source or the shore power source socket installed thereon, if any, has an unknown configuration.

Once wires from the three-phase electrical cable are installed within adapter 120 and adapter 120 is fully assembled, electrical potting resin, silicone sealant or another similar material known in the art can be used to waterproof adapter 120.

While the particular System and method for Connecting go Marine Shore Power as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as described in the appended claims.

What is claimed:

1. A system for connecting to marine shore power comprising:

a vessel plug comprising:
a male plug component; and
a housing;

a plurality of adapters, each comprising:
a female socket component; and
a male adapter component;

wherein the housing of the vessel plug receives and installs on a vessel's shore power cable;

wherein the female socket component and the male adapter component are opposite each other;

wherein the female socket component of each of the plurality of adapters interchangeably attaches to the male plug component of the vessel plug, creating an electrical connection there between;

wherein the male adapter components of the plurality of adapters are each configured differently and unique from each other and are compatible with and attach or connect to a shore power source with a socket installed thereon having a known configuration or are otherwise uniquely configured to attach or connect to the shore power source regardless of the configuration of the shore power source or the socket installed thereon, if any, creating an electrical connection between each male adapter component and the shore power source;

wherein the shore power source is provided to a vessel at marinas where the vessel docks, is connected to an electrical power grid or an electricity source, and provides the vessel access to three-phase electrical power when docked at the marinas;

wherein installing the housing of the vessel plug on the vessel's shore power cable, plugging into the socket installed on the shore power source the male adapter component of one of the plurality of adapters which is compatible thereto, and connecting the vessel plug to the female socket component of the adapter creates an electrical connection between the vessel's shore power cable and the shore power source providing electricity thereto;

wherein the vessel plug and the plurality of adapters are configured to provide three-phase electrical power to the vessel, up to, including, and exceeding 100 amperes of current, regardless of the configuration of the shore power source or the configuration of the socket, if any, installed on the shore power source;

wherein the vessel plug further comprises: a ground pin, a neutral pin, an L1 phase pin, an L2 phase pin, and an L3 phase pin, with each comprising a first end piece and a second end piece; a terminal block comprising a top portion and a bottom portion; a smash seal; a compression nut a lock ring having locking tabs; and the housing comprising a first end and a second end;

wherein the male plug component is comprised of the top portion of the terminal block, comprising: the first end pieces of the ground pin, neutral pin, L1 phase pin, L2 phase pin, and L3 phase pin; a top portion of a receptacle; and a circular plug housing;

wherein the bottom portion of the terminal block is comprised of: the second end pieces of the ground pin, neutral pin, L1 phase pin, L2 phase pin, and L3 phase pin; a bottom portion of the receptacle; and a wiring cover;

wherein the first end pieces of the ground pin, neutral pin, L1 phase pin, L2 phase pin, and L3 phase pin insert into the bottom portion of the receptacle and through to the top portion of the receptacle and are enclosed within the circular plug housing;

wherein the wiring cover together with the bottom portion of the receptacle enclose the second end pieces of the ground pin, neutral pin, L1 phase pin, L2 phase pin, and L3 phase pin;

wherein the second end pieces of the ground pin, neutral pin, L1 phase pin, L2 phase pin, and L3 phase pin each have a terminal comprised of a hollow cavity to receive and secure at least one wire of the vessel's shore power cable, creating an electrical connection between the wire and the respective pin;

wherein the first end of the housing has an opening to receive the bottom portion of the terminal block;

wherein the circular plug housing attaches to the first end of the housing thereby securing the bottom portion of the terminal block within the opening of the housing and securing the lock ring to the first end of the housing so that the lock ring can rotates freely about the outer surface of the housing near the opening;

wherein the second end of the housing has an internally recessed bevel creating a cylindrical pocket to receive the smash seal; and wherein further the second end of the housing and the compression nut have complimentary threading allowing the compression nut to be threaded onto the second end of the housing.

2. The system for connecting to marine shore power of claim 1, wherein each of the plurality of adapters further comprises:

an adapter ground pin, an adapter neutral pin, an L1 adapter phase pin, an L2 adapter phase pin, and an L3 adapter phase pin, each comprising a first end portion and a second end portion;

an adapter terminal block comprising a first end and a second end;

an adapter housing comprising a first end and a second end; and an adapter lock ring having locking tabs which secure each of the plurality of adapters to the socket installed on the shore power source;

wherein the female socket component is comprised of the second end of the adapter terminal block; the second end portions of the adapter ground pin, adapter neutral pin, L1 adapter phase pin, L2 adapter phase pin, and L3 adapter phase pin; and a circular recess having an alignment channel;

wherein each of the second end portions of the adapter ground pin, adapter neutral pin, L1 adapter phase pin, L2 adapter phase pin, and L3 adapter phase pin has a cavity to receive the first end piece of the respective vessel plug ground pin, neutral pin, L1 phase pin, L2 phase pin, and L3 phase pin, creating an electrical connection between each second end portion and the respective first end piece;

wherein each of the second end portions of the adapter ground pin, adapter neutral pin, L1 adapter phase pin, L2 adapter phase pin, and L3 adapter phase pin is enclosed within the adapter terminal block, with the cavities of each accessible through the second end of the adapter terminal block, creating an adapter ground terminal, an adapter neutral terminal, an L1 adapter phase terminal, an L2 adapter phase terminal, and an L3 adapter phase terminal;

wherein the first end portions of the adapter ground pin, adapter neutral pin, L1 adapter phase pin, L2 adapter phase pin, and L3 adapter phase pin protrude from the first end of the adapter terminal block;

wherein the male adapter component is comprised of the adapter housing, the adapter lock ring, and the first end portions of the adapter ground pin, adapter neutral pin, L1 adapter phase pin, L2 adapter phase pin, and L3 adapter phase pin;

wherein the second end of the adapter housing has a flange which extends perpendicular to and circumferentially around the second end of the adapter housing;

wherein the flange of the second end of the adapter housing attaches to the first end of the adapter terminal block enclosing the first end portions of the adapter ground pin, adapter neutral pin, L1 adapter phase pin, L2 adapter phase pin, and L3 adapter phase pin within the adapter housing and enclosing the second end portions thereof within the adapter terminal block;

wherein the adapter terminal block is further comprised of two lock plates diametrically opposite each other which extend semi-circumferentially and perpendicularly from the outer surface of the adapter terminal block nearest the second end of the adapter terminal block;

wherein each lock plate has a vertical height which increases from a first end to a second end of each lock plate, creating a ramp which ends at a tab abutting the second end of each lock plate;

wherein inserting the male plug component of the vessel plug into the female socket component of any of the plurality of adapters and turning the lock ring of the vessel plug clockwise results in the bottom surface of each locking tab of the lock ring sliding along the top surface of each lock plate from its first end to its second end until each locking tab is stopped by the tab abutting the second end of each lock plate, fully seating and securing the adapter onto the vessel plug.

3. The system for connecting to marine shore power of claim 2, wherein one or more of the plurality of adapters have a male adapter component comprised of the first end portions of the adapter ground pin, L1 adapter phase pin, L2 adapter phase pin, and L3 adapter phase pin, the adapter housing, and the adapter lock ring; and wherein the male adapter component attaches to the socket installed on the shore power source having a configuration of only four pin terminals, one for each adapter ground pin, L1 adapter phase pin, L2 adapter phase pin, and L3 adapter phase pin.

4. The system for connecting to marine shore power of claim 2, wherein the male adapter component of one or more of the plurality of adapters is comprised of an adapter cover and the first end portions of the adapter ground pin, adapter neutral pin, L1 adapter phase pin, L2 adapter phase pin, and L3 adapter phase pin;

wherein each of the first end portions of the adapter ground pin, adapter neutral pin, L1 adapter phase pin, L2 adapter phase pin, and L3 adapter phase pin have a cavity to receive secure, and connect a first end of respective ground, neutral, and L1, L2, and L3 phase wires from a three-phase electrical cable, creating an electrical connection between each first end portion of the adapter ground pin, neutral pin, L1, L2, and L3 adapter phase pins and the first end of respective wires of the three-phase electrical cable;

wherein the cavities of the first end portions each of the adapter ground pin, adapter neutral pin, and L1, L2, and L3 phase pins enable the vessel's shore power cable to be connected to the shore power source having the three-phase electrical cable with no socket installed thereon;

wherein the male adapter component, with the first ends of respective ground, neutral, and L1, L2, and L3 phase wires of the three-phase electrical cable connected thereto enables the vessel's shore power cable to be connected to the shore power source which ordinarily requires hard wiring the vessel's shore power cable to the shore power source, by hardwiring a second end of each of the respective ground, neutral, and L1, L2, and L3 phase wires of the the three-phase electrical cable to the shore power source; and wherein the male adapter component of the adapter, with the first ends of respective ground, neutral, and L1, L2, and L3 phase wires of the three-phase electrical cable connected thereto, enables the vessel's shore power cable to be connected to the socket installed on the shore power source having an unknown configuration by installing the second end of each of the respective ground, neutral, and L1, L2, and L3 phase wires of the three-phase electrical cable to a sourced plug compatible with the unknown configuration of the socket installed on the shore power source, creating a custom adapter which connects the vessel's shore power cable to the shore power source.

5. The system for connecting to marine shore power of claim 1, wherein the vessel plug installed on the vessel's shore power cable, along with the plurality of adapters, eliminate the need for multiple bulky and expensive cable sets or the need to rewire the vessel's shore power cable with a different plug each time the vessel berths in a marina where the shore power source has an unknown configuration or the socket installed thereon has a configuration which is not compatible with the vessel's shore power plug.

6. The system for connecting to marine shore power of claim 1, wherein the vessel plug installed on the vessel's shore power cable, along with the plurality of adapters, meet the needs of supplying the vessel with high amperage three-phase electricity from the shore power source regardless of the configuration of the shore power source or the configuration of the socket installed thereon.

7. The system for connecting to marine shore power of claim 1, wherein the vessel plug installed on the vessel's shore power cable, along with the plurality of adapters, are easy to use, efficient and relatively inexpensive.

8. The system for connecting to marine shore power of claim 1, wherein the vessel's shore power cable is connected to the shore power source by simply plugging into the socket installed on the shore power source, the male adapter component of one of the plurality of adapters which is compatible thereto, and plugging into the female socket component, the vessel plug that is installed on the vessel's shore power cable.

9. A system for connecting to marine shore power comprising:

a vessel plug having a male plug component; and a plurality of adapters with each having a female socket component and a male adapter component;

wherein the vessel plug is intended to replace a plug installed on a vessel's shore power cable by being installed directly on the vessel's shore power cable;

wherein the male plug component of the vessel plug is compatible with and plugs into the female socket component of each of the plurality of adapters;

wherein the male adapter components are each configured uniquely to enable the vessel's shore power cable to be connected to a shore power source regardless of the configuration of the shore power source or the configuration of a socket installed on the shore power source;

wherein the shore power source is provided to a vessel at marinas where the vessel docks, is connected to an electrical power grid or an electricity source, and provides the vessel access to three-phase electrical power when docked at the marinas;

wherein the male adapter component of one or more of the plurality of adapters is comprised of an adapter cover and the first end portions of the adapter ground pin, adapter neutral pin, L1 adapter phase pin, L2 adapter phase pin, and L3 adapter phase pin;

wherein each of the first end portions of the adapter ground pin, adapter neutral pin, L1 adapter phase pin, L2 adapter phase pin, and L3 adapter phase pin have a cavity to receive, secure, and connect a first end of respective ground, neutral, and L1, L2, and L3 phase wires from a three-phase electrical cable, creating an electrical connection between each first end portion of the adapter ground pin, neutral pin, L1, L2, and L3 adapter phase pins and the first end of respective wires of the three-phase electrical cable;

wherein the cavities of the first end portions of the adapter ground pin, adapter neutral pin, and L1, L2, and L3 adapter phase pins enable the vessel's shore power cable to be connected to the shore power source having the three-phase electrical cable with no socket installed thereon;

wherein the male adapter component, with the first ends of respective ground, neutral, and L1, L2, and L3 phase wires of the three-phase electrical cable connected thereto, enables the vessel's shore power cable to be connected to the shore power source which ordinarily requires hard wiring the vessel's shore power cable to the shore power source, by instead, hardwiring a second end of each of the respective ground, neutral, and L1, L2, and L3 phase wires of the three-phase electrical cable to the shore power source; and wherein the male adapter component of the adapter, with the first ends of respective ground, neutral, and L1, L2, and L3 phase wires of the three-phase electrical cable connected thereto, enables the vessel's shore power cable to be connected to the socket installed on the shore power source having an unknown configuration by installing the second end of each of the respective ground, neutral, and L1, L2, and L3 phase wires of the three-phase electrical cable to a sourced plug compatible with the unknown configuration of the socket installed on the shore power source, creating a custom adapter which connects the vessel's shore power cable to the shore power source.

10. The system for connecting to marine shore power of claim 9, wherein the majority of the plurality of adapters have configurations matching a variety of known four and five pin socket configurations used internationally;

wherein the majority of the plurality of adapters enable the vessel's shore power cable to be connected to the shore power source having any of the known four and five pin sockets installed thereon.

11. The system for connecting to marine shore power of claim 9, wherein the male adapter component of at least one or more of the plurality of adapters is comprised of adapter ground, adapter neutral, and L1, L2 and L3 adapter phase ins with hollow cavities which receive, secure, and connect a first end of respective ground, neutral, and L1, L2, and L3 phase wires of the three-phase electrical cable;

wherein the hollow cavities of the adapter ground, adapter neutral and L1, L2 and L3 adapter phase pins of the male adapter component connect to the shore power source by receiving, and securing the first ends of respective ground, neutral, and L1, L2, and L3 phase wires of the three-phase power cable of the shore power source with no socket installed thereon;

wherein the male adapter component, with the first ends of respective ground, neutral, and L1, L2, and L3 phase wires of the three-phase electrical cable connected thereto, enables the vessel's shore power cable, with the vessel plug stalled thereon, to be connected to the shore power source having no three-phase electrical cable and which ordinarily requires hard wiring the vessel's shore power cable to the shore power source, by hardwiring a second end of each of the respective ground, neutral, and L1, L2, and L3 phase wires of the three-phase electrical cable to the shore power source; and wherein the male adapter component of the adapter, with the first ends of respective ground, neutral, and L1, L2, and L3 phase wires of the three-phase electrical cable connected thereto, enables the vessel's shore power cable to be connected to the socket installed on the shore power source having an unknown configuration by installing the second end of each of the respective ground, neutral, and L1, L2, and L3 phase wires of the three-phase electrical cable to a sourced plug compatible with the socket having the unknown configuration, creating a custom adapter which connects the vessel's shore power cable to the shore power source.

12. The system for connecting to marine shore power of claim 9, wherein the male adapter component of one or more of the plurality of adapters has a configuration which is compatible with the socket installed on the shore power source which has only a ground terminal, an L1 phase terminal, an L2 phase terminal, and an L3 phase terminal.

13. The system for connecting to marine shore power of claim 9, wherein the vessel plug installed on the vessel's shore power cable, along with the plurality of adapters, eliminate the need for multiple bulky and expensive cable sets or the need to rewire the vessel's shore power cable with a different plug each time the vessel berths in a marina where the sore power source provided has an unknown configuration or the socket installed thereon, if any, has a configuration that is not compatible with the vessel's shore power plug configuration.

14. The system for connecting to marine shore power of claim 9, wherein the vessel plug installed on the vessel's shore power cable, along with the plurality of adapters, meet the needs of supplying the vessel with high amperage three-phase electricity from the shore power source regardless of the configuration of the shore power source or the configuration of the socket installed on the shore power source.

15. The system for connecting to marine shore power of claim 9, wherein the vessel plug installed on the vessel's shore power cable, along with the plurality of adapters, are easy to use, efficient and relatively inexpensive.

16. The system for connecting to marine shore power of claim 9, wherein the vessel is connected to the shore power source by simply plugging into the socket installed on the shore power source the male adapter component of one of the plurality of adapters, which is compatible thereto, and plugging the vessel plug installed on the vessel's shore power cable into the female socket component of the adapter.

* * * * *